US008023876B2

(12) United States Patent
Kikuchi

(10) Patent No.: US 8,023,876 B2
(45) Date of Patent: Sep. 20, 2011

(54) FIXING DEVICE AND IMAGE FORMING APPARATUS

(75) Inventor: Kazuhiko Kikuchi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 454 days.

(21) Appl. No.: 12/207,149

(22) Filed: Sep. 9, 2008

(65) Prior Publication Data

US 2009/0067899 A1 Mar. 12, 2009

Related U.S. Application Data

(60) Provisional application No. 60/971,534, filed on Sep. 11, 2007.

(51) Int. Cl.
*G03G 15/20* (2006.01)

(52) U.S. Cl. ..... 399/329; 219/216

(58) Field of Classification Search ..... 399/329, 399/328, 69; 219/216; 347/156
See application file for complete search history.

(56) References Cited

U.S. PATENT DOCUMENTS

| | | | | |
|---|---|---|---|---|
| 6,137,985 | A * | 10/2000 | Kinouchi et al. | 399/329 |
| 2006/0165447 | A1 * | 7/2006 | Onodera | 399/329 |
| 2006/0171731 | A1 * | 8/2006 | Yoshikawa | 399/69 |
| 2006/0210292 | A1 * | 9/2006 | Kinouchi et al. | 399/69 |
| 2006/0285893 | A1 * | 12/2006 | Ishii | 399/329 |
| 2007/0014600 | A1 * | 1/2007 | Ishii et al. | 399/328 |
| 2007/0166085 | A1 * | 7/2007 | Shinshi | 399/329 |

FOREIGN PATENT DOCUMENTS

| | | | |
|---|---|---|---|
| JP | 2005-017757 | A * | 1/2005 |
| JP | 2006-171368 | | 6/2006 |

* cited by examiner

*Primary Examiner* — Sophia S Chen
(74) *Attorney, Agent, or Firm* — Patterson & Sheridan, LLP

(57) ABSTRACT

According to an aspect of the invention, a fixing device includes, a fixing member that fixes an image onto a sheet, a satellite member arranged parallel to the fixing member with respect to an axial direction and having a smaller heat capacity than the fixing member, an endless belt laid over the fixing member and the satellite member, and a pressurizing member facing the fixing member and forming a nip via the endless belt.

19 Claims, 8 Drawing Sheets

| Temperature difference | Visual evaluation (5 stages) |
|---|---|
| 0℃ | — |
| 2℃ | ◎ |
| 4℃ | ◎ |
| 6℃ | ○ |
| 8℃ | △ |
| 10℃ | × |
| 15℃ | ×× |

| Heat capacity | Fe pipe t1.0 | AL three-arrow t1.0 | AL three-arrow t1.5 | SUS solid | AL pipe t2 | AL pipe t1 |
|---|---|---|---|---|---|---|
| (J/K) | 16 | 8 | 15 | 33 | 15 | 13 |

FIXING DEVICE AND IMAGE FORMING APPARATUS

CROSS-REFERENCE TO RELATED APPLICATIONS

This Application claims the benefit of U.S. Provisional Application No. 60/971,534, filed on Sep. 11, 2007.

TECHNICAL FIELD

The present invention relates to a belt fixing device that fixes an image onto a fixing target material, in an image forming apparatus such as an electrostatic copy machine or printer.

BACKGROUND

As a fixing device used for a copy machine or printer employing an electrophotographic system, a fixing device that performs heating and pressurization by using rollers is known. This fixing device includes a fixing roller that is heated to a high temperature, and a pressurizing roller that presses this fixing roller in contact with a recording sheet. In the fixing device, an unfixed image on the recording sheet is passed through a nip (operating part) formed by the fixing roller and the pressurizing roller, and the unfixed image on the recording sheet is thus fixed by heat and pressure.

In a color fixing device, unlike a monochrome fixing device, since four toner layers need to be fixed, smoothness of the toner surface after fixation is required in order to acquire high image quality. Therefore, a belt fixing device is often used. Also, recently, from the environmental view point (energy saving), a belt fixing device that uses an induction heating (IH) system of good thermal efficiency using a halogen lamp as a heat source is becoming employed.

However, though in the above example, a fixing belt as a heating unit on the image side is heated by an induction heating coil, an apparatus, particularly, a high-speed machine which is significantly deprived of heat has a disadvantage (problem) that it is difficult to simultaneously achieve high-speed heating, and maintenance of temperature and improvement in uneven gloss in continuous printing.

SUMMARY

According to an aspect of the invention, a fixing device comprises, a fixing member that fixes an image onto a sheet, a satellite member arranged parallel to the fixing member with respect to an axial direction and having a smaller heat capacity than the fixing member, an endless belt laid over the fixing member and the satellite member, and a pressurizing member facing the fixing member and forming a nip via the endless belt.

According to another aspect of the invention, a fixing device comprises, a fixing roller that rotates about a shaft extending along a direction of width which intersects a traveling direction of a processing medium, an auxiliary member having a smaller heat capacity than the fixing roller and having a shaft extending along the direction of width, a belt laid across an outer circumference of the fixing roller and an outer circumference of the auxiliary member, a pressurizing member that faces the fixing roller and is pressed in contact with the fixing roller via the belt and the processing medium, and a heating unit configured to heat the belt.

According to another aspect of the invention, an image forming apparatus comprises, a photoconductive member that holds a change in potential in an area irradiated with light, as an electrostatic image, a developing device that supplies toner to the photoconductive member and visualizes the electrostatic image, a transfer device that transfers a toner image on the photoconductive member to an output medium a fixing roller that provides heat to the toner image an auxiliary member having a smaller heat capacity than the fixing roller a belt laid across an outer circumference of the fixing roller and of the auxiliary member, and a heating unit configured to heat the belt.

Objects and advantages of the invention will become apparent from the description which follows, or may be learned by practice of the invention.

DESCRIPTION OF THE DRAWINGS

The accompanying drawings illustrate embodiments of the invention, and together with the general description given above and the detailed description given below, serve to explain the principles of the invention.

DETAILED DESCRIPTION

First Embodiment

Figure 1:
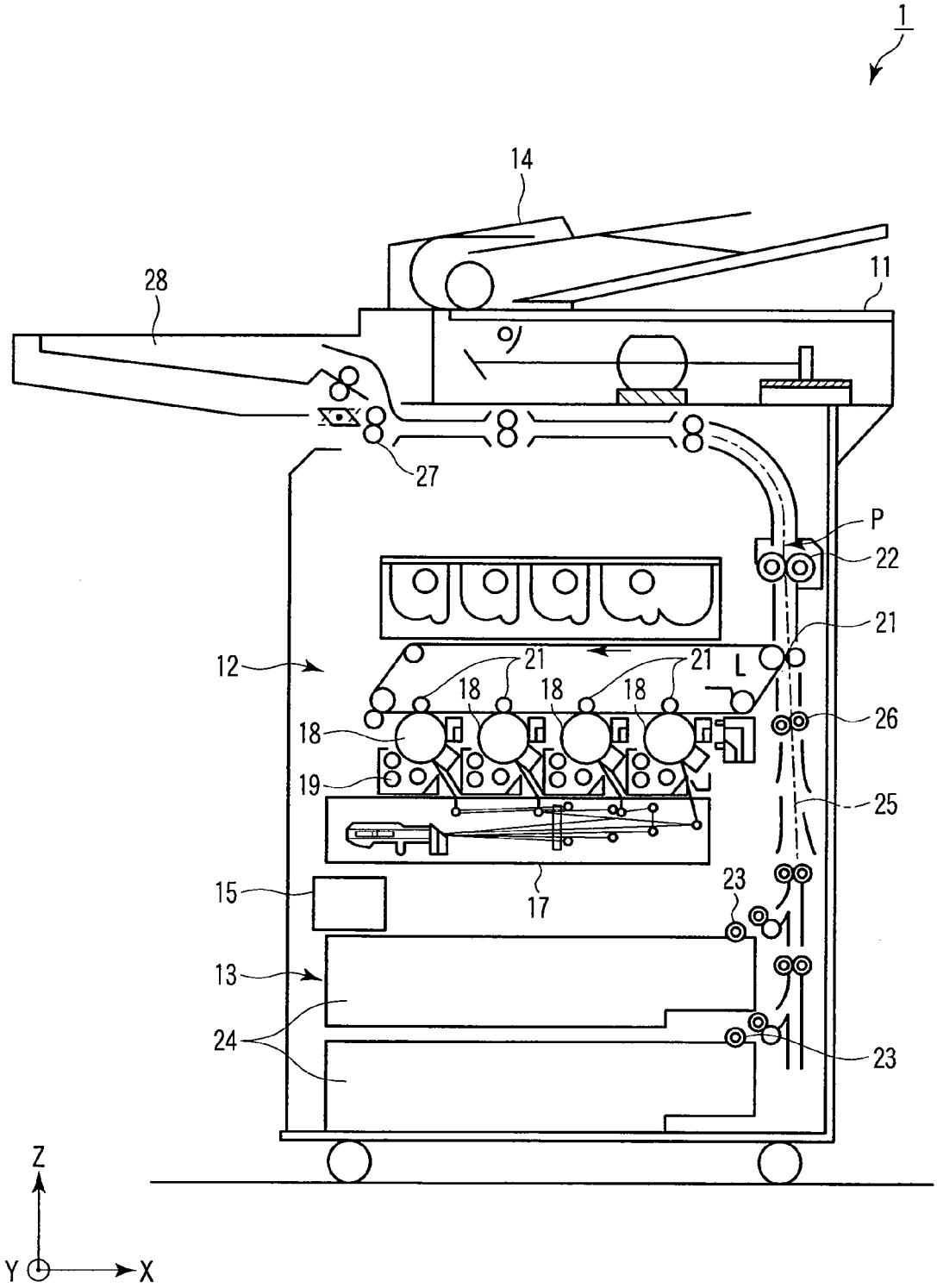
FIG. 1 is a schematic view for explaining an image forming apparatus according to a first embodiment.

Hereinafter, a fixing device 22 and an image forming apparatus 1 according to an embodiment will be described. In the drawings, the configuration is properly enlarged, reduced or omitted and thus schematically shown. In the drawings, X, Y and Z represent three directions orthogonal to each other. Here, a digital copy machine is described as an example of the embodiment.

The image forming apparatus 1 shown in FIG. 1 is a digital copy machine. The image forming apparatus 1 includes an image scanning device (scanner) 11 that captures a target image as different brightness of light and photoelectrically converts the image to generate an image signal, an image forming unit 12 that forms an image corresponding to the image signal supplied from the scanner 11 or from outside and fixes the image onto a sheet P as a processing medium, a sheet supply unit 13 that holds sheets and supplies sheets to the image forming unit 12, and a CPU (control unit) 15 that comprehensively controls operations.

The scanner 11 is integrally provided with an automatic document feeder (ADF) 14 that, when output media are sheet-like media, sequentially switches copy targets, interlocking with the image scanning by the scanner 11.

The image forming unit 12 includes an exposure device 17, photoconductive drums 18, developing devices 19, a transfer device 21 and a fixing device 22.

The exposure device 17 outputs a laser beam with its light intensity changed according to image information supplied from the scanner 11 or an external device. The image information is exposed to light on the photoconductive drums 18 by the exposure device 17. An electrostatic image is thus formed on the photoconductive drums 18.

Each photoconductive drum 18 is cylindrical. As light is cast onto the photoconductive drum 18 with a predetermined potential given thereto, the potential in the area irradiated with light changes and the change in potential is held as an electrostatic image on the outer circumferential surface of the photoconductive drum for a predetermined period. The image information is exposed to light on the photoconductive drums 18 by the exposure device 17.

The developing devices 19 selectively supply toner (developer) and thus visualize the image formed on the photoconductive drums 18.

The transfer device 21 supplies a voltage for transfer and thus transfers the aggregate of toner, that is, the toner image on the photoconductive drums 18 to a transfer material P fed by a sheet carrying unit.

The fixing device 22 is heated and pressurized, thus melts the toner image transferred to the transfer material P, and fixes the toner image to the transfer material P.

Figure 2A:
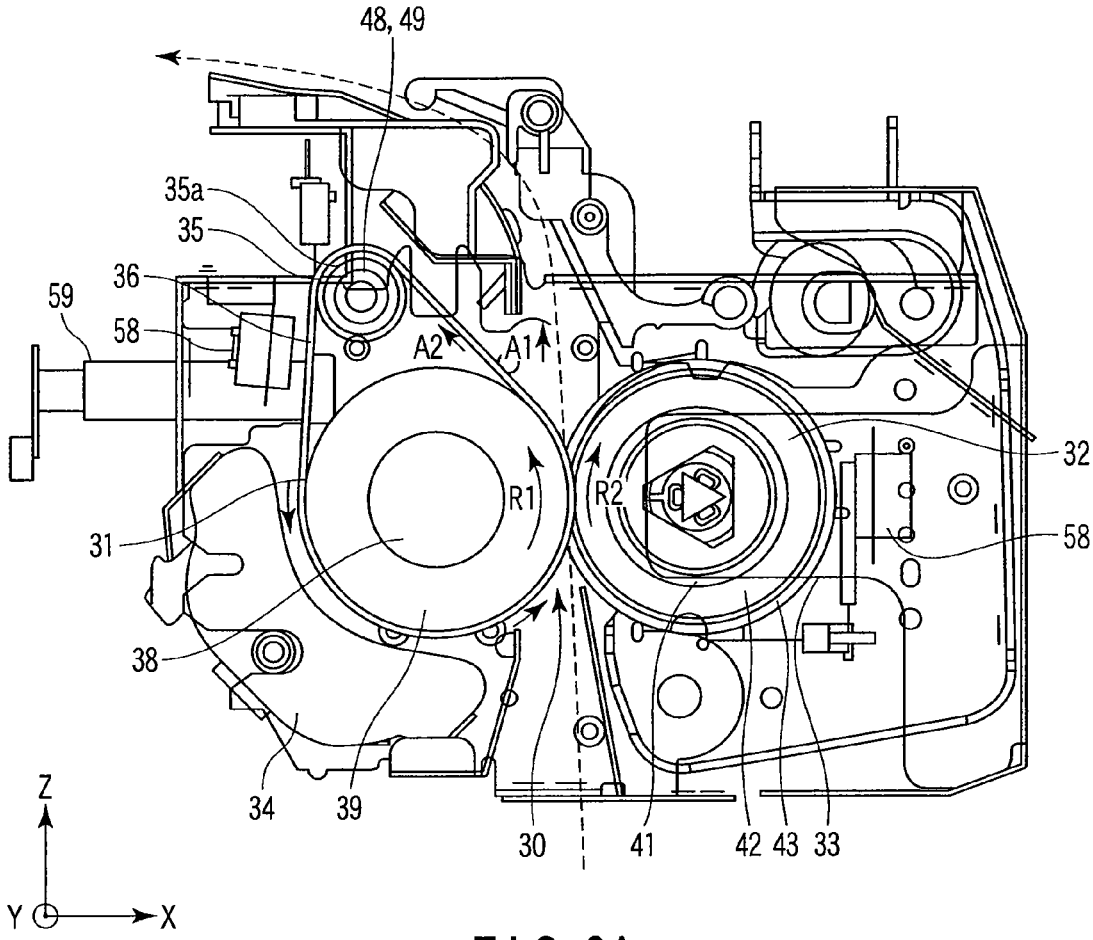
FIG. 2A is a schematic view for explaining a fixing device of the image forming apparatus.
Figure 2B:
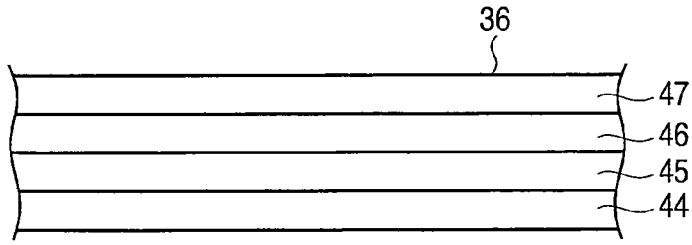
FIG. 2B is a schematic view for explaining a fixing belt of the image forming apparatus.
Figure 3:
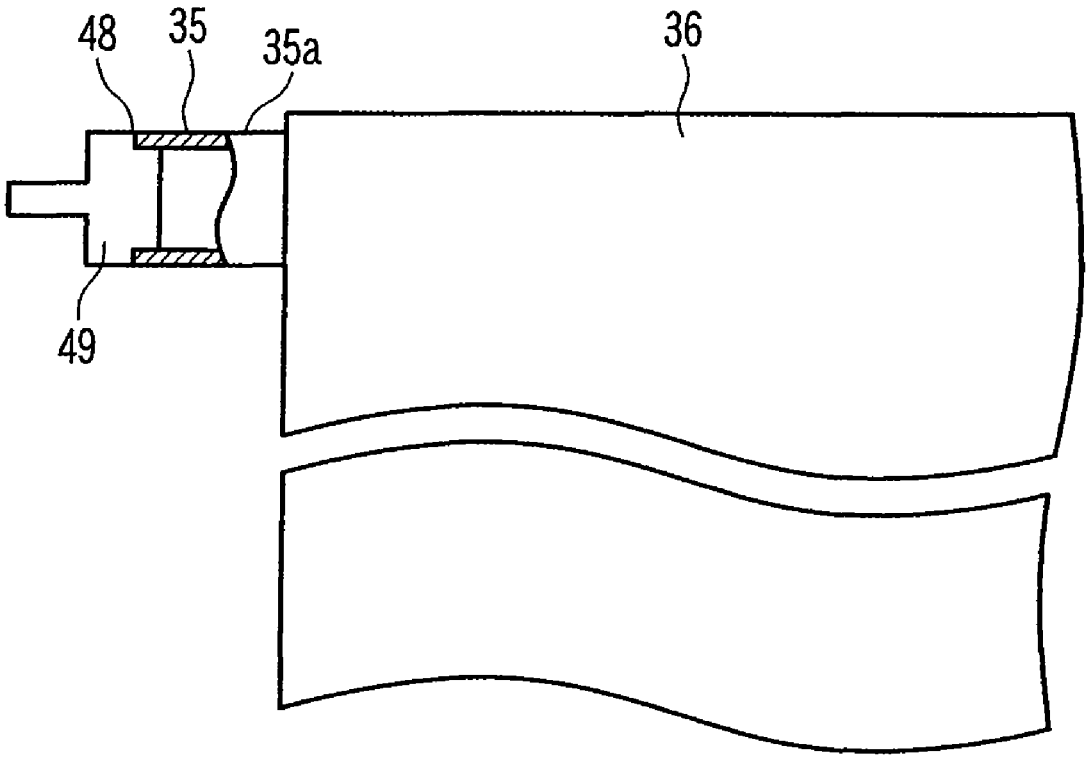
FIG. 3 is a side view showing a part of a fixing device of the image forming apparatus.

FIG. 2A is a schematic view for explaining an example of the fixing device 22 used for an image forming apparatus. FIG. 2B is a schematic view for explaining a fixing belt 36. FIG. 3 is a side view for explaining an example of the fixing device 22.

The fixing device 22 has a fixing roller 31, and a pressurizing roller 32 that provides a predetermined pressure to the fixing roller 31. A satellite roller 35 is arranged at an upper left position from the fixing roller 31. A fixing belt (belt) 36 is laid across the outer circumference of the fixing roller 31 and the outer circumference of the satellite roller 35. The fixing device 22 also has a pressurizing mechanism 33 that provides a predetermined pressure to the pressurizing roller 32, and an induction heating device 34 (heating mechanism, heating unit, or heating source) that raises the temperature of the fixing roller 31, the satellite roller 35 (auxiliary member or satellite member) and the fixing belt 36 by utilizing induction heating. Fixing is carried out when the sheet P is carried upward from below in a traveling direction indicated by an arrow A1 in a nip 30 between the fixing roller 31 (fixing member) and the pressurizing roller 32 (pressurizing member).

The fixing roller 31 rotates in the direction of an arrow R1 about a shaft extending in the direction of width that intersects the traveling direction of the processing medium. The fixing roller 31 can contact the surface of the sheet P to which toner is adhering, and heats the toner and the sheet P. The fixing roller 31 (minicell roller) includes a core metal 38 made of a hollow metal pipe and having an outer diameter ϕ of 30 mm and a thickness t of 3 mm, and a porous silicon sponge layer (body part) 39 formed on the outer circumference of the core-metal 38 and having a very small and uniform cell diameter and a thickness t of 9.25 mm. It is preferable that the elastic member (porous silicon sponge layer (body part) 39) has a thickness of 5 to 15 mm. In this embodiment, for example, the thickness t is 9.25 mm. The elastic member 39 is silicon rubber foam with a cell diameter of 50 μm.

The fixing roller 31 has an outer diameter ϕ of 48.5 mm. The core metal 38 is made of an iron material in consideration of magnetic circuit matching in IH heating by the heating device 34.

The porous silicon sponge layer 39 (body part) having the very small and uniform cell diameter is made of a material having such a characteristic that its hardness gradually increases if pressurized and heated for a long period. The body part 39 has a heat capacity of 45 [J/K].

The pressurizing roller 32 is arranged to face the fixing roller 31 and rotates in the direction of an arrow R2 about a shaft extending along the direction of width. The pressurizing roller 32 has a core metal 41 made of a hollow metal pipe and having an outer diameter ϕ of 46 mm and a thickness t of 2 mm, a silicon rubber layer 42 formed on the outer circumference of the core metal 41 and having a thickness t of 2 mm, and a 30-μm PFA tube 43 applied on the outer circumference of the silicon rubber layer 42. As the pressurizing roller 32 is pressed by the pressurizing mechanism 33, the pressurizing roller 32 is pressed in contact with the fixing roller 31 via the fixing belt 36 and the sheet P.

The fixing belt 36 is an endless belt and is laid across the outer circumference of the fixing roller 31 and the outer circumference of the satellite roller 35. As showing in the FIG. 2B, the fixing belt 36 includes a base layer 44, and three layers formed on the base layer 44, that is, an adhesive layer 45, an elastic layer 46 and a separation layer 47 in this order. The base layer 44 is principally made of Ni metal with a thickness of 40 μm. The adhesive layer 45 has a thickness of 20 μm. The elastic layer 46 is made of 200-μm silicon rubber (solid). The separation layer 47 is made of a 30-μm PFA layer (fluorine-based resin). It is preferable that the thickness of the metal layer is 30 to 70 μm, and its thickness is 40 μm in this embodiment. It is preferable that the thickness of the silicon rubber is 0.1 to 0.5 mm, and its thickness is 200 μm in this embodiment. It is preferable that the thickness of the PFA layer is 0.03 to 0.2 mm, and its thickness is 30 μm in this embodiment. The rotation in the direction R1 of the fixing roller 31 on the inner side of the fixing belt 36 causes the fixing belt 36 to rotate into the direction A2. The heating source of the fixing belt 36 is induction heating by the IH coil of the induction heating device 34 arranged on the outer side of the belt 36.

The satellite roller 35 includes a hollow cylindrical body part 35*a* made of aluminum with an outer diameter ϕ of 17 and a thickness t of 2. At an axial end part 48, a flange 49 made of iron or SUS is pressed in contact. The heat capacity of the body part 35*a* is 15 [J/K]. That is, the satellite roller 35 has a smaller heat capacity than the fixing roller 31. The satellite roller 35 is arranged at an upper left position from the fixing roller 31 and rotates about a shaft extending along the direction of the width of the sheet P (Y-direction). The satellite roller 35 has a roller outer diameter that is ½ of the roller outer diameter of the fixing roller 31 or less, and has a heat capacity of 15 J/K or more. The satellite roller 35 is arranged upstream from the heating unit of the endless belt with respect to the rotating direction of the fixing roller.

The pressurizing mechanism (pressure providing mechanism) 33 has an elastic member such as a spring, and has the function of pressing the pressurizing roller 32 to the fixing roller 31 by using the elastic force of the elastic member. At the contacting part between the fixing roller 31 and the pressurizing roller 32, the nip 30 having a predetermined width (nip width) in the carrying direction (traveling direction) of the sheet P is formed. The fixing roller 31 is rotated in the direction of the arrow R1 by a driving motor. Along with the rotation of the fixing roller 31, the pressurizing roller 32 is rotated in the direction of the arrow R2.

In the longitudinal direction (axial direction) of the fixing roller 31, a temperature detector 58 that detects the temperature of the fixing roller 31, and a thermostat 59 that detects anomaly in the surface temperature of the fixing roller 31 and stops supply of power for heating the fixing roller 31 are arranged. Also, a temperature detector 58 that detects the temperature of the pressurizing roller 32 is arranged on an outer circumferential part of the pressurizing roller 32. The temperature detectors 58 are non-contact temperature detectors using a thermopile or thermistor.

The induction heating device 34 has a heating (IH) coil. As a control current with a frequency of 40 kHz or higher is supplied under the control of the CPU (control unit) 15 that comprehensively controls the operation of the fixing device 22, the induction heating device 34 generates a predetermined magnetic field. This magnetic field causes an eddy-current to flow through the fixing belt 36 and generate Joule heat in accordance with the resistance value of the conductive part. Thus, heat is generated in the fixing belt 36. For example, U.S. Pat. No. 7,305,197 discloses an example of using a driving current with a frequency of 40 kHz or higher. In U.S. Pat. No. 7,305,197, a driving current with a frequency of 40 to 80 kHz is used, which can also be applied to this embodiment. The induction heating device 34 is arranged at a position on the outer side of the fixing belt 36 and close to an outer circumferential part on the lower left side of the fixing roller 31. That is, with respect to the belt feeding direction (A2), the induction heating device 34 is arranged upstream from the nip 30 of the fixing roller 31, which is the contacting part between the fixing belt and the sheet P (output medium), and downstream from the satellite roller 35.

In the image forming apparatus 1 as described above, an image signal is supplied from the scanner 11 or an external device, and a laser beam, not described in detail, is cast from the exposure device 17 to a predetermined position on the photoconductive drums 18 charged to a predetermined potential in advance. The laser beam from the exposure device 17 has its intensity modified in accordance with the image signal. Thus, an electrostatic latent image corresponding to the image to be copied (outputted) is formed on the photoconductive drums 18.

As toner is selectively provided from the developing devices 19, the electrostatic latent images formed on the photoconductive drums 18 are developed and converted to toner images, not shown.

The toner images on the photoconductive drums 18 are transferred onto the sheet the transfer material, that is, the sheet P, supplied to the transfer position by the transfer device 21. The sheet P is taken out one by one from a sheet cassette 24 by a pickup roller 23 of the sheet supply unit, and is carried in advance to aligning rollers 26 through a carrying path 25 defined between the photoconductive drums 18 and the sheet cassette 24. This sheet P is supplied to the transfer position 21 in adjusted feed timing in order to be aligned with the toner images formed on the photoconductive drums 18 by the aligning rollers 26.

The toner transferred to the sheet P by the transfer device 21 is carried to the fixing device 22. As the toner on the sheet P is melted and simultaneously pressurized by the fixing device 22, the toner is fixed to the sheet P. That is, as the sheet P holding the toner passes through the nip 30 formed between the fixing roller 31 and the pressurizing roller 32, the toner is melted and the melted toner is compressed in contact with the sheet P. The image is thus fixed.

The sheet P having the toner image fixed thereto by the fixing device 22 is discharged to a paper discharge tray 28 by paper discharge rollers 27 and is stacked in order.

Figure 4:
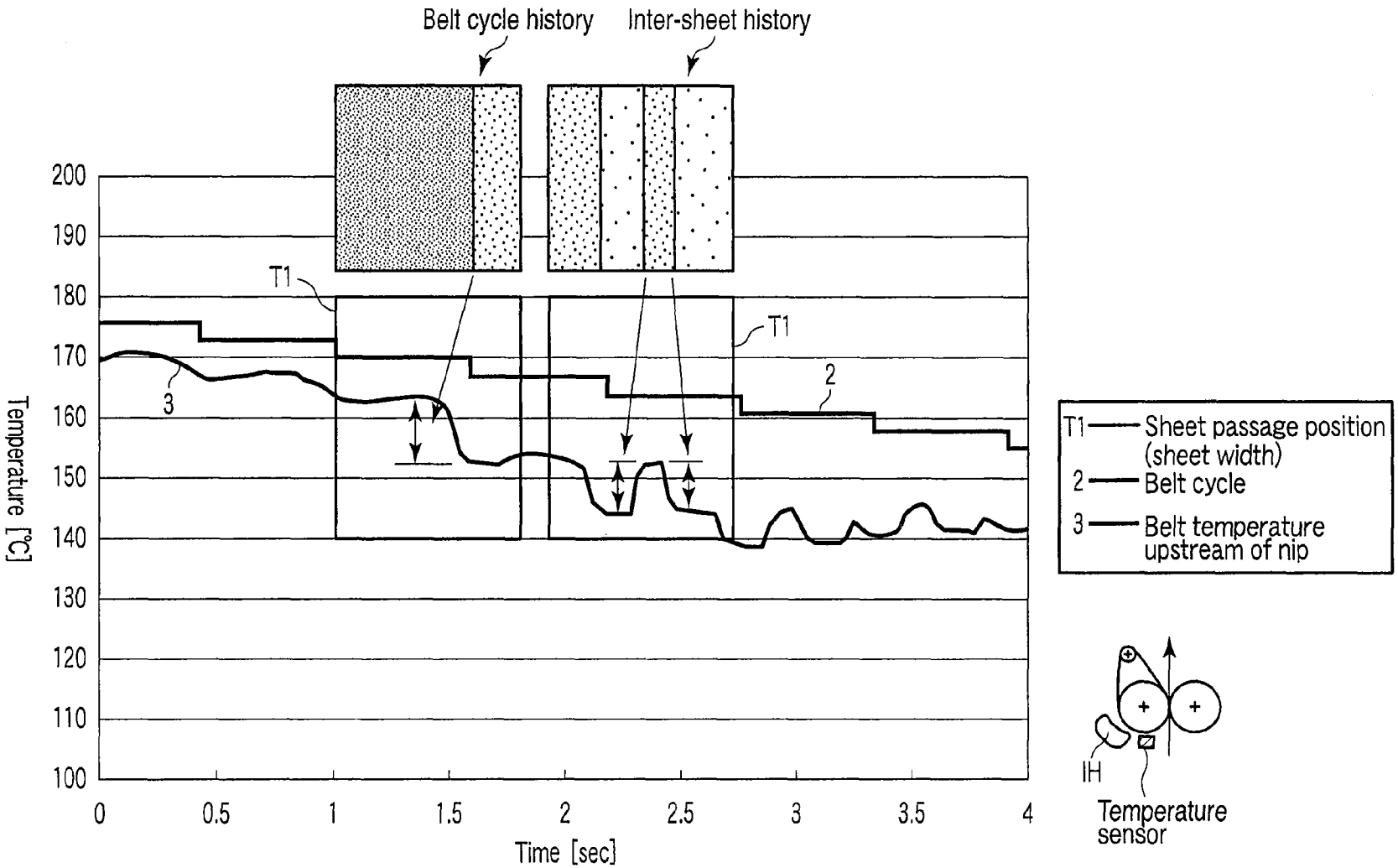
FIG. 4 is an explanatory view for explaining a cause of unevenness of an image in the fixing device.

A cause of uneven gloss, which is a form of deterioration in image quality, will be described with reference to FIG. 4. In FIG. 4, the horizontal axis represents time (sec) and the vertical axis represents temperature (° C.). Numeral T1 in FIG. 4 indicated the sheet passing position (sheet width), 2 indicates the belt cycle, and 3 indicates the belt temperature upstream of the nip.

When a sheet longer than the circumferential length of the fixing belt passes through the nip, the sheet passing part of the fixing belt is deprived of heat and its temperature is lowered. The fixing belt with the lowered temperature is heated by the heating unit (induction heating). However, for normal paper having a maximum basis weight (for example, paper of 22 grams), the original temperature is not easily restored even if the fixing belt is heated by the heating unit. Therefore, a temperature difference occurs within the same sheet P in the second turn of the belt and this causes a gloss difference in the image. Moreover, since the fixing belt is deprived of heat by the pressurizing roller, a temperature difference similarly occurs in the second turn of the belt and this tends to cause a gloss difference in the image.

The opposite phenomenon occurs between a sheet P and another sheet P. That is, since the belt is not deprived of heat between sheets and the belt is reheated by the heating unit, the state of high belt temperature occurs only between sheets. Therefore, when a belt part corresponding to the space between sheets passes at a halfway part of two continuous sheets, a similar temperature difference occurs and is therefore outputted as uneven gloss.

The temperature difference that can be determined by human eyes as uneven gloss depends on the quantity of toner adhesion and the basis weight of sheet, but approximately 5 to 7° C. with the maximum quantity of toner adhesion.

Figures 9, 10:
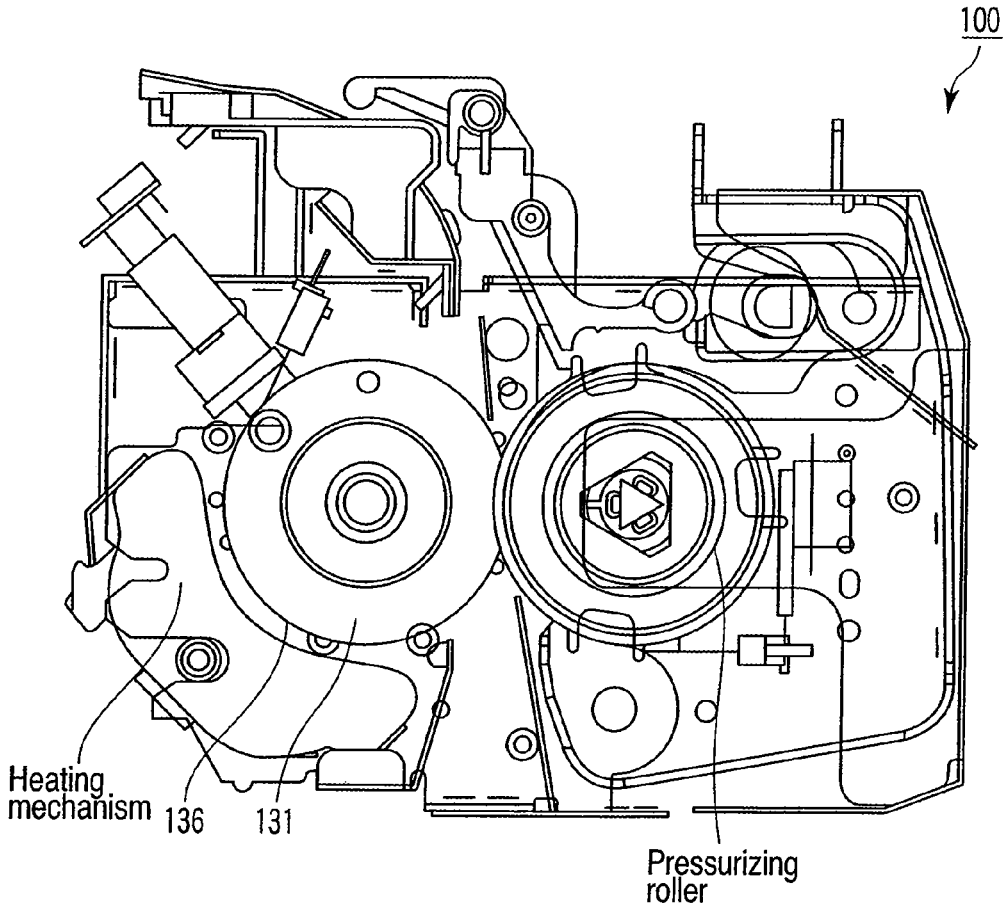
FIG. 9 is a table showing heat capacity of a satellite roller according to another embodiment.
FIG. 10 is a schematic view for explaining an exemplary fixing device as a comparative device.

FIG. 10 shows a fixing device 100 as a comparative device to the fixing device 22. In the fixing device 100, a fixing belt 136 covers the entire outer circumference of a fixing roller 131. No satellite roller is provided in this fixing device 100. The fixing device 100 is a belt fixing device employing a system of directly heating the fixing belt alone, instead of heating the fixing roller arranged on the inner side of the fixing belt. This fixing device has an on-demand structure in which the endless belt as a heating target member has a very small heat capacity, thereby achieving shorter warm-up and contributing to energy saving. When the fixing device 100 is used in a color high-speed machine, a temperature fall due to passage of a sheet appears as uneven temperature in the belt cycle because of the presence four layers of toner, maintenance of temperature in thick-paper high-speed operation, and the very small heat capacity of the heating target member (endless belt).

In the fixing device 22 according to the embodiment, to improve the uneven gloss, the satellite roller 35 arranged on the inner side of the fixing belt 36 is arranges downstream of the nip and upstream of the heating (IH) coil with respect to the rotating direction of the fixing roller 31. Thus, the temperature (step) difference is made gentler by the satellite roller 35 before the belt 36 is quickly heated by the heating (IH) coil. In this way, a longer distance to the nip position can be taken after improvement in the temperature (step) difference. This can promote temperature diffusion in the metal layer of the belt 36.

The fixing device 22 according to the embodiment has the following advantages. As the satellite roller 35 having a predetermined heat capacity is arranged on the inner side of the fixing belt 36, the fixing belt 36 acts as a heating target member having an apparent heat capacity and thus contributes to maintenance of temperature. Therefore, uneven gloss can be prevented. Moreover, since the belt system is adopted, smoothness of the toner surface after fixation can be secured. Also, since the induction heating (IH) system is used as a heat source, good thermal efficiency is achieved.

Figures 5, 6:
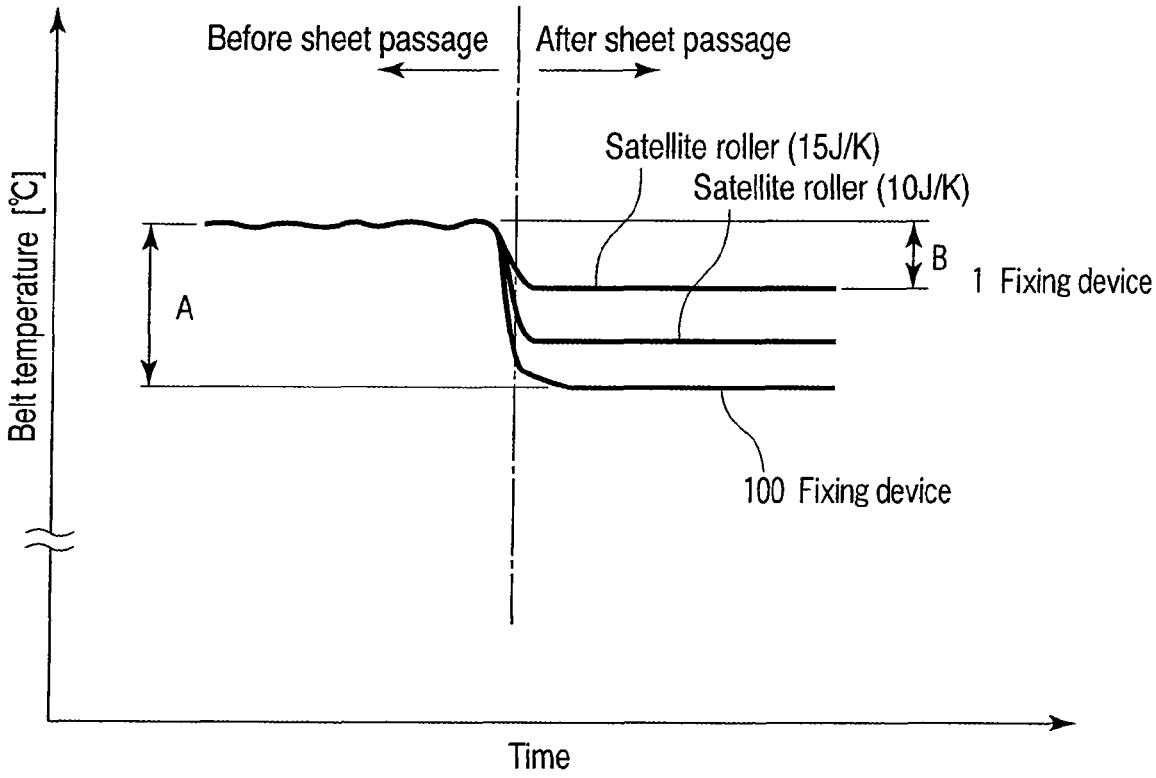
FIG. 5 is a graph showing transition of belt temperature before and after passage of a sheet in the fixing device according to the first embodiment and a fixing device as a comparative device.
FIG. 6 shows the results of evaluation of uneven gloss in an image with respect to temperature difference in the cycle of a fixing belt according to the first embodiment.

FIG. 5 and FIG. 6 show these advantages. FIG. 5 is a graph showing transition of belt temperature before and after passage of a sheet in the fixing device 22 according to the embodiment and in the fixing device 100 shown in FIG. 10 as a comparative device. The vertical axis represents temperature (° C.) of the belt and the horizontal axis represents time.

As shown in FIG. 5, the temperature difference A in the fixing device 100 as a comparative device is approximately 10° C. and the temperature difference B in the fixing device 22 according to the embodiment is about 4° C. Therefore, it can be confirmed that the fixing device 22 according to the embodiment has an uneven gloss improvement effect.

FIG. 5 is a graph showing the temperature difference due to the heat capacity [J/K] of the satellite roller 35. As can be seen from the graph, if the heat capacity of the satellite roller 35 is 15 [J/K] or more, the temperature difference is 4° C. or less and uneven gloss is invisible. The heat capacity of the satellite roller 35 refers to the heat capacity in the area of the roller body part 35*a* (except for the axial end part or flange).

FIG. 6 shows the results of evaluation of uneven gloss in the image with respect to the temperature difference in the cycle of the fixing belt 36. The degree of gloss can be numerically expressed by using a glossmeter or the like. However, since human eyes are more sensitive to uneven gloss than numeric values in evaluation, five stages of visual evaluations are employed. As can be seen from the results, if the temperature difference is lowered to 6° C. or lower, uneven gloss is improved. More preferably, a temperature difference of 4° C. or lower is desirable.

Figure 7:
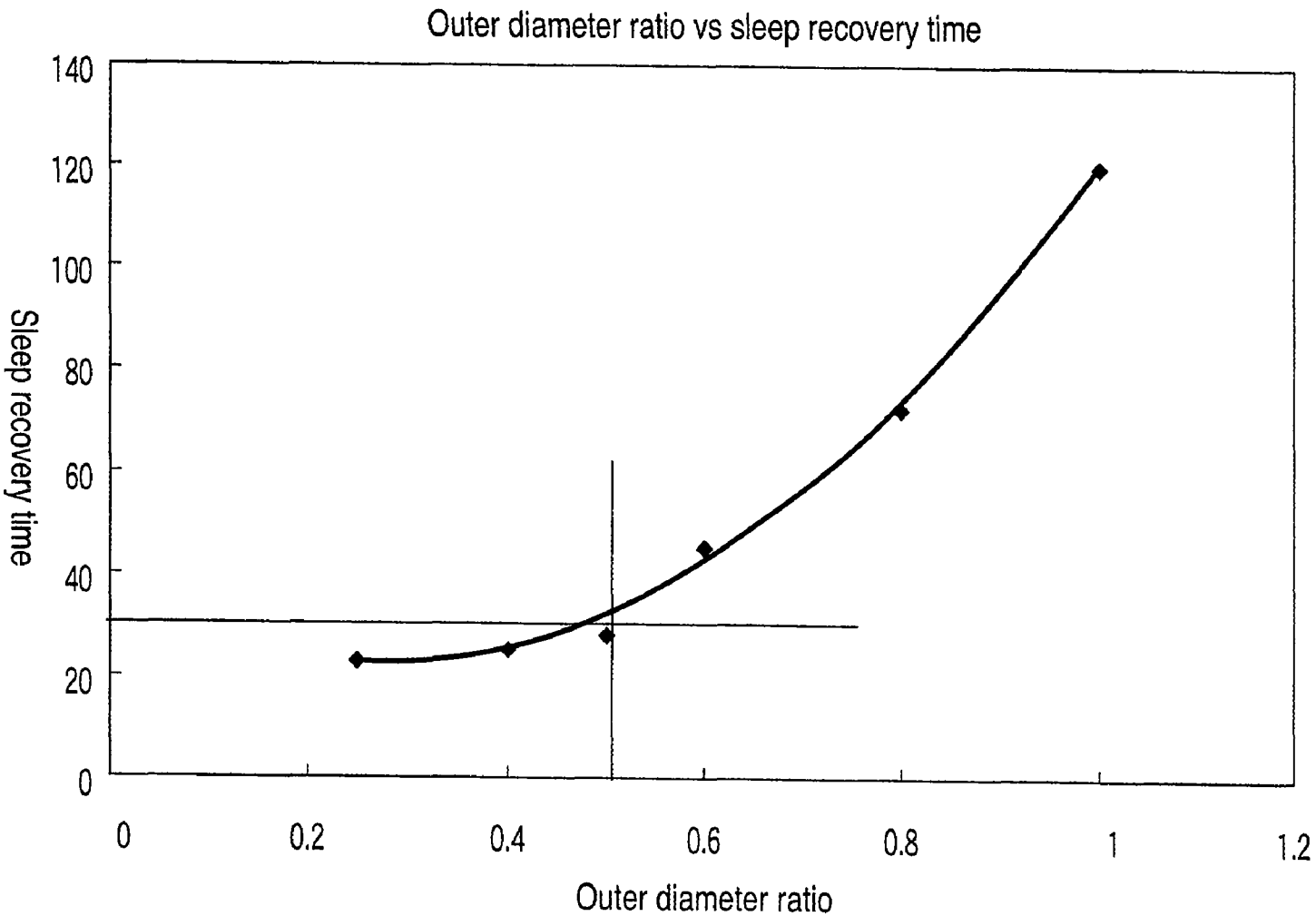
FIG. 7 is a graph showing the relation between the outer diameter ratio between a fixing roller 31 and a satellite roller 35 according to the embodiment, and sleep recovery time.

FIG. 7 is a graph showing the relation between the outer diameter ratio of the fixing roller 31 and the satellite roller 35 and the sleep recovery time. As a measuring condition of sleep recovery, time when recovery is done one hour after a shift to sleep is made immediately after warming up at an ambient temperature of 20° C., is shown.

A shorter sleep recovery time is more convenience. However, if the heat capacity is reduced for this, waiting (to stop printing until temperature is recovered) due to a temperature fall occurs in continuous printing. Therefore, performance is lowered, which is not user-friendly. A recovery time of 30 seconds or less can be determined as substantially good.

As seen from the graph of FIG. 7, if the outer diameter ratio of the fixing roller 31 and the satellite roller 35 is 2:1 (0.5) or less, the sleep recovery time is 30 seconds or less and waiting does not occur even in continuous printing of 500 sheets or more.

Figure 8:
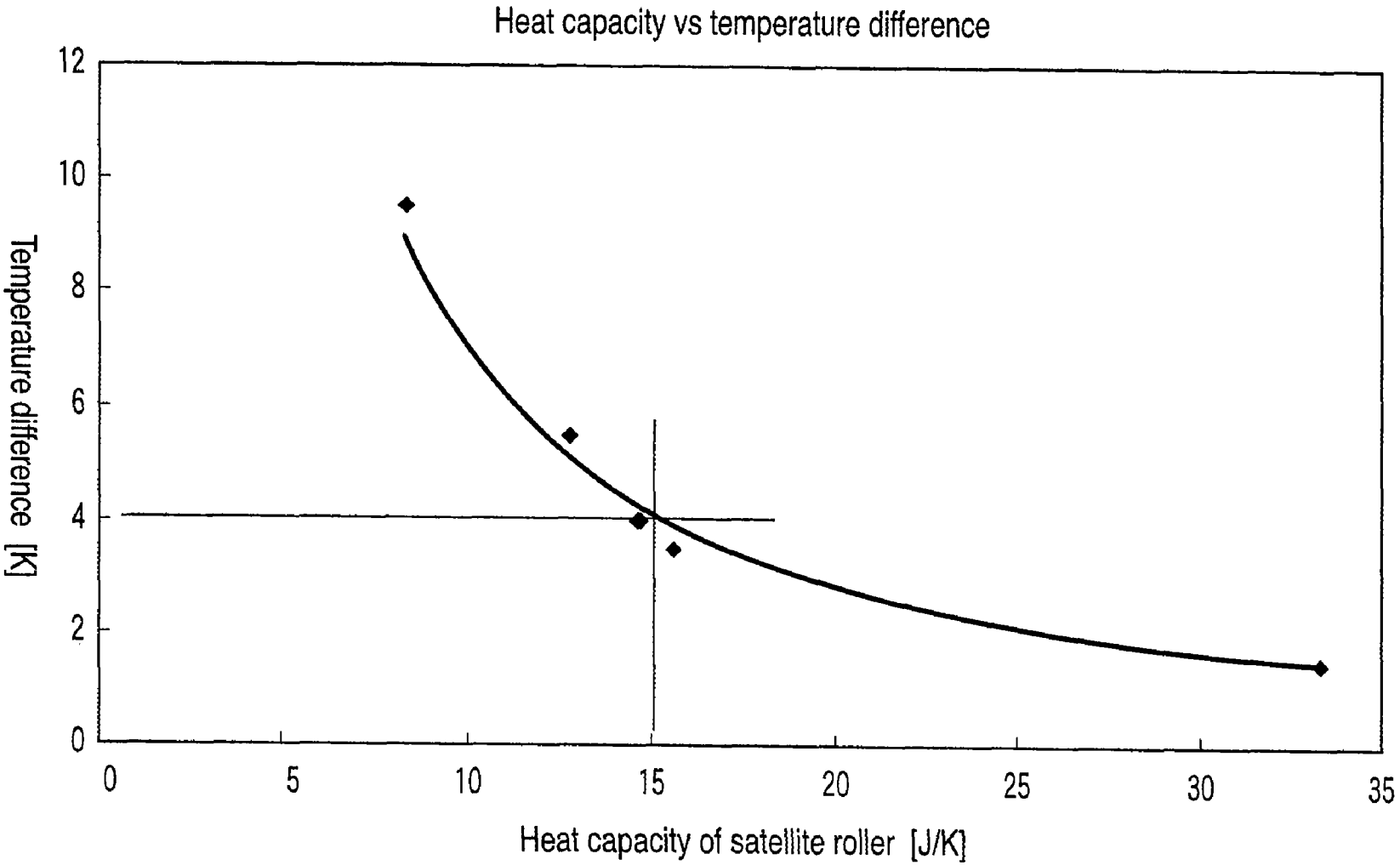
FIG. 8 is a graph showing temperature difference in the cycle of the fixing belt when printing is carried out, in the fixing device according to the embodiment.

FIG. 8 is a graph showing temperature difference in the cycle of the fixing belt 36 when printing is done, in the fixing device 22 using the satellite roller 35.

As can be seen from the graph, if the heat capacity is 15 [J/K] or more, the temperature difference is 4° C. or less. However, if the heat capacity of the satellite roller 35 is equivalent to or greater than the heat capacity of the fixing roller, greater power is necessary to heat the satellite roller 35. Therefore, it is desirable that the heat capacity of the satellite roller 35 is smaller than the heat capacity of the fixing roller 31. The heat capacity of the fixing roller 31 refers to the heat capacity in the area of the body part 39 of the roller (except for the axial end part or flange).

To improve the above condition, the roller called satellite roller 35 having a predetermined heat capacity like the one shown in FIG. 2 is arranged parallel to the axial direction of the fixing roller 31. Thus, the endless belt (fixing belt) 36 acts as a heating target member having an apparent heat capacity and thereby contributes to maintenance of temperature.

The invention is not limited to the above embodiment. Specific configurations including the shape, material and so on of each member can be suitably changed. For example, in the first embodiment, the satellite roller 35 is configured as an aluminum hollow cylinder, but it is not limited to this configuration. As the material of the satellite roller 35, Fe, SUS and so on can also be applied. The shape can be, for example, a solid columnar or a three-arrow shape in addition to the hollow pipe structure. Moreover, the thickness is not limited to the above and can be suitably changed. FIG. 9 shows the heat capacity of satellite rollers using various materials, shapes and thicknesses as other embodiments. As shown in FIG. 9, a satellite roller made of Fe, pipe-shaped and having a thickness of 1.0 mm has a heat capacity of 16 J/K. A satellite roller made of Al and having a three-arrow shape and a thickness of 1.0 mm has a heat capacity of 8 J/K. A satellite roller made of Al and having a three-arrow shape and a thickness of 1.5 mm has a heat capacity of 15 J/K. A satellite roller made of SUS and having a solid round bar shape has a heat capacity of 33 J/K. A satellite roller made of Al, pipe-shaped and having a thickness of 2.0 mm has a heat capacity of 15 J/K. A satellite roller made of Al, pipe-shaped and having a thickness of 1.0 mm has a heat capacity of 13 J/K. In addition to satellite rollers made of hollow metals including iron, SUS, aluminum and so on, a satellite roller including a heat pipe enclosed in a hollow metal including iron, SUS, aluminum or the like can also be used.

While the base layer principally made of Ni metal is used in the embodiment, the base layer may also be made of magnetic stainless steel, iron or the like.

Components of the invention can be modified in practice without departing from the scope of the invention. Also, various inventions can be made by proper combinations of plural components disclosed in the embodiment. For example, some of the components disclosed in the embodiment may be deleted. Moreover, components in different embodiments may be properly combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device comprising:

a fixing member that fixes an image onto a sheet;

a satellite member arranged parallel to the fixing member with respect to an axial direction and having a smaller heat capacity than the fixing member;

an endless belt laid over the fixing member and the satellite member;

a pressurizing member facing the fixing member and forming a nip via the endless belt; and a heating unit that heats the endless belt and is provided on an outer side of the endless belt, upstream of the nip between the endless belt and the pressurizing member and downstream of the satellite member in a feeding direction of the endless belt.

2. The device according to claim 1, wherein the fixing member has an elastic member and the elastic member has a thickness of 5 to 15 mm.

3. The device according to claim 2, wherein the elastic member is silicon rubber foam having a cell diameter of 50 μm or less.

4. The device according to claim 1, wherein the satellite member includes a hollow metal selected at least from iron, SUS, and aluminum.

5. The device according to claim 1, wherein the satellite member includes a heat pipe enclosed in a hollow metal selected at least from iron, SUS, and aluminum.

6. The device according to claim 1, wherein the endless belt has a separation layer, an elastic layer, and a metal layer in order from a side contacting the sheet.

7. The device according to claim 6, wherein the metal layer includes a metal selected at least from magnetic stainless steel, iron, and nickel.

8. The device according to claim 6, wherein the metal layer has a thickness of 30 to 70 μm.

9. The device according to claim 6, wherein the elastic layer includes silicon rubber (solid).

10. The device according to claim 9, wherein the silicon rubber has a thickness of 0.1 to 0.5 mm.

11. The device according to claim 6, wherein the separation layer includes fluorine-based resin.

12. The device according to claim 6, wherein the separation layer has a thickness of 0.03 to 0.2 mm.

13. The device according to claim 1, wherein the heating unit heats the fixing member while the fixing member is nipping the endless belt.

14. The device according to claim 1, wherein the heating unit provides induction heating with an IH coil arranged outside.

15. The device according to claim 1, wherein a temperature detector on both the endless belt and the pressurizing member, and one or both of the temperature detectors include a non-contact temperature detector using a thermopile or thermistor.

16. The device according to claim 1, wherein the satellite member has a heat capacity of 15 J/K or more, and the satellite member is arranged upstream from a heating source of the endless belt with respect to a rotating direction of the fixing member.

17. A fixing device comprising:

a fixing roller that rotates about a shaft extending along a direction of width which intersects a traveling direction of a processing medium;

an auxiliary member having a smaller heat capacity than the fixing roller and having a shaft extending along the direction of width;

an endless belt laid across an outer circumference of the fixing roller and an outer circumference of the auxiliary member;

a pressurizing member that faces the fixing roller and is pressed in contact with the fixing roller via the endless belt and the processing medium; and a heating unit configured to heat the endless belt and provided on an outer side of the endless belt, upstream of a nip between the endless belt and the pressurizing member and downstream of the auxiliary member in a feeding direction of the endless belt.

18. The device according to claim 17, wherein the heating unit is provided upstream of a contacting part between the endless belt and the processing medium in the feeding direction of the endless belt.

19. An image forming apparatus comprising:

a photoconductive member that holds a change in potential in an area irradiated with light, as an electrostatic image;

a developing device that supplies toner to the photoconductive member and visualizes the electrostatic image;

a transfer device that transfers a toner image on the photoconductive member to an output medium;

a fixing roller that provides heat to the toner image;

an auxiliary member having a smaller heat capacity than the fixing roller;

an endless belt laid across an outer circumference of the fixing roller and of the auxiliary member; and a heating unit configured to heat the endless belt and provided on an outer side of the endless belt, upstream of a nip between the endless belt and a pressurizing member and downstream of the auxiliary member in a feeding direction of the endless belt.

* * * * *